US005456577A

United States Patent [19]

O'Sullivan et al.

[11] Patent Number: 5,456,577

[45] Date of Patent: Oct. 10, 1995

[54] CENTRIFUGAL PUMP WITH RESILIENTLY BIASING DIFFUSER

[75] Inventors: Mark E. O'Sullivan, Phillipsburg, N.J.; Timothty L. Wotring, Emmaus, Pa.

[73] Assignee: Ingersoll-Dresser Pump Company, Liberty Corner, N.J.

[21] Appl. No.: 282,108

[22] Filed: Jul. 28, 1994

[51] Int. Cl.[6] ..... F04D 1/06; F04D 29/44; F04D 29/60

[52] U.S. Cl. ..... 415/199.2; 415/140; 415/208.2

[58] Field of Search ..... 415/140, 141, 415/199.1, 199.2, 208.1, 208.2

[56] References Cited

U.S. PATENT DOCUMENTS

| | | | |
|---|---|---|---|
| 2,280,626 | 4/1942 | Carpenter | 415/199.2 |
| 3,098,450 | 7/1963 | Bower | 415/199.2 |
| 3,154,020 | 10/1964 | Sieghartner . | |
| 3,612,716 | 10/1971 | Deters | 415/140 |
| 3,756,738 | 9/1973 | Lee | 415/199.1 |
| 4,098,558 | 7/1978 | Bush et al. | 415/199.1 |
| 4,218,181 | 8/1980 | Komatsu et al. | 415/199.1 |
| 4,244,675 | 1/1981 | Bower | 415/199.1 |
| 4,579,509 | 4/1986 | Jacobi . | |
| 4,778,334 | 10/1988 | Medgyesy . | |

*Primary Examiner*—Edward K. Look
*Assistant Examiner*—Michael S. Lee
*Attorney, Agent, or Firm*—Michael H. Minns; Robert F. Palermo

[57] ABSTRACT

A multistage centrifugal pump having a last stage diffuser which acts as a compensator to load the suction and intermediate pressure gaskets during pump operation and pump stand-by. The last stage diffuser is designed as a spring which deflects under varying conditions and imparts a spring force on the channel rings during assembly, stand-by and other operating conditions.

11 Claims, 4 Drawing Sheets

CENTRIFUGAL PUMP WITH RESILIENTLY BIASING DIFFUSER

BACKGROUND OF THE INVENTION

This invention relates generally to multistage centrifugal pumps and more particularly to expansion compensators for multistage centrifugal pumps.

Double case, radially split barrel pumps, such as the pump shown in FIGS. 1 and 3, are used extensively in high pressure boiler feed service. The double cased design consists of a channel ring assembly 24, or bundle, which seals inter-stage pressure. The bundle 24 is fit into an outer pressure vessel, known as a barrel 3. Inside each channel ring 24 is a stationary diffuser 22 and a rotating impeller 15. Frequently in boiler feed applications, an intermediate stage pressure bleed-off line 35 is required. The bleed-off fluid is used for reheater attemporation spray which regulates reheater temperature. When an intermediate stage take-off 35 is required, intermediate stage pressure exists in the clearance between the channel ring assembly or bundle 24 and the barrel 3. Spiral wound gaskets 31 seated against machined steps in the barrel 3 seal the intermediate pressure from the suction and discharge pressure. In addition to creating a static seal between joints, gaskets 30 (discharge gasket), 31 also act as an expansion compensator. This permits the bundles 24 to expand within the barrel 3, allowing for differential thermal expansion and preventing distortion or misalignment of the internal components.

In existing compensator designs, shown in FIG. 3, erosion of the barrel base metal has been experienced around the suction gasket 32, primarily in turbine-driven pumps which are operated frequently at low speeds (the slow-roll condition). Here, the axial force generated by pressure is less that the minimum gasket seating load, resulting in an improper seal and washing in the barrel at the suction gasket (shown by arrow 34).

Another potential problem with existing compensator designs may occur when a pump is on stand-by. Spiral wound gaskets are crushed to a designed compression during pump operations. The gaskets are plastically deformed and do not retain the pre-stressed geometry. When the pump is stopped and placed on stand-by, the gaskets are unloaded. Due to the limited recovery characteristics of a plastically deformed spiral wound gasket, a gap 38 can exist between the bundle 24 and the barrel 3. This can cause erosion in the discharge head.

The foregoing illustrates limitations known to exist in present multistage centrifugal pump expansion compensators. Thus, it is apparent that it would be advantageous to provide an alternative directed to overcoming one or more of the limitations set forth above. Accordingly, a suitable alternative is provided including features more fully disclosed hereinafter.

SUMMARY OF THE INVENTION

In one aspect of the present invention, this is accomplished by providing a multistage centrifugal pump comprising: a pump housing having an inlet and an outlet; a plurality of intermediate pumping stages within the pump housing, each intermediate pumping stage comprising an impeller, a diffuser member and a channel ring member; and a discharge pumping stage within the pump housing, the discharge pumping stage comprising an impeller and a diffuser member; at least one diffuser member resiliently axially biasing the channel ring members.

The foregoing and other aspects will become apparent from the following detailed description of the invention when considered in conjunction with the accompanying drawing figures.

BRIEF DESCRIPTION OF THE DRAWING FIGURES

DETAILED DESCRIPTION

Figure 1:
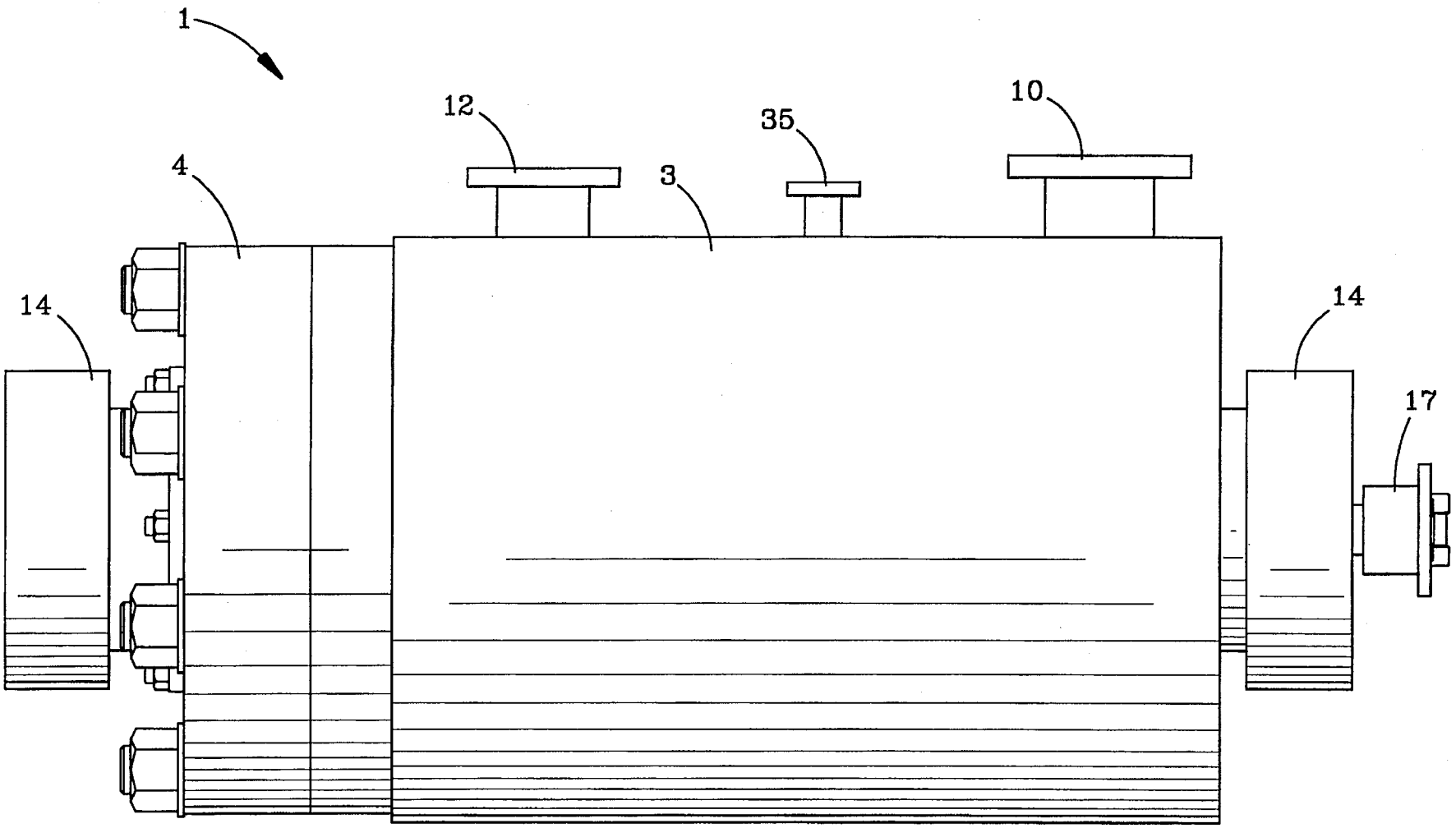
FIG. 1 is a side view of a multistage centrifugal pump.

FIG. 1 shows a multistage centrifugal pump 1 having an inlet 10, intermediate stage pressure take-off 35 and an outlet 12. The multiple pumping stages are enclosed within a pump housing or barrel 3. One end of the centrifugal pump 1 is closed by a pump end casing 4 bolted to the pump housing 3. At each end of the centrifugal pump 1 is a bearing housing 14. A shaft 20 is provided with a coupling 17 for connecting the pump 1 to a driving device (not shown) such as an electric motor or steam driven turbine.

Figure 2:
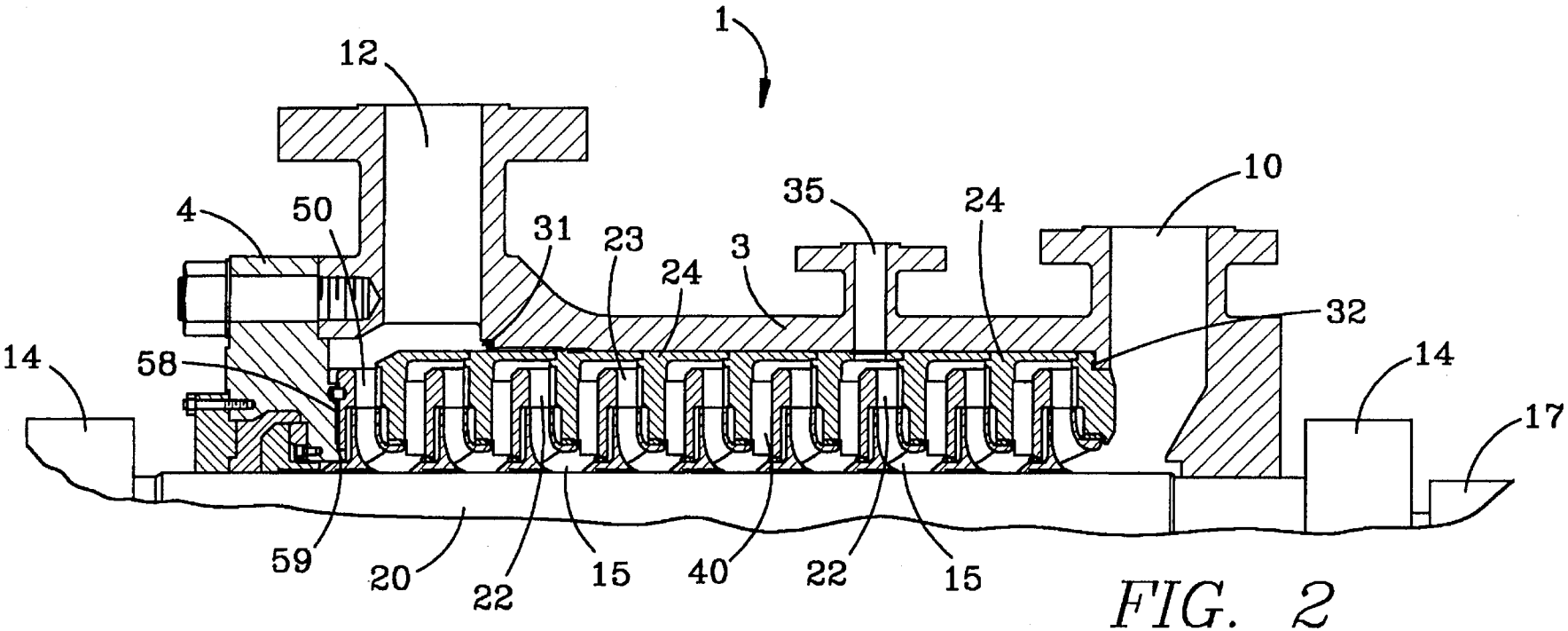
FIG. 2 is a cross-section of a portion of the multistage centrifugal pump shown in FIG. 1.
Figure 3:
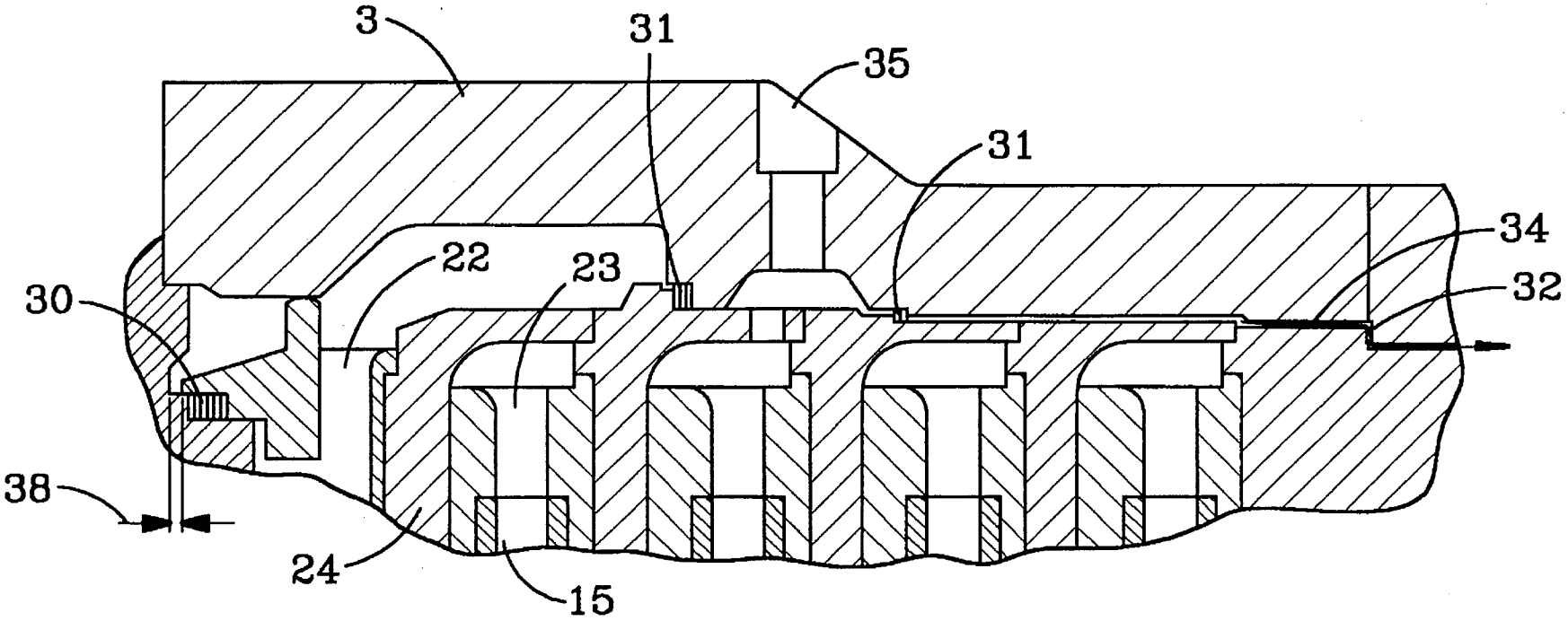
FIG. 3 (PRIOR ART)
FIG. 3 is a partial cross-sectional view of a multistage centrifugal pump illustrating a prior art expansion compensator.

A view of the pumping stages of the pump internals is shown in FIG. 2. The interior of the centrifugal pump 1 contains a plurality of pumping stages, each consisting of an impeller 15 attached to a rotating shaft 20, an intermediate stage diffuser 22 with diffuser vanes 23 and return vanes 40 and a channel ring or bundle 24. As shown in FIG. 2, the last or discharge pumping stage does not include a channel ring 24. The pumped fluid enters an impeller 15 attached to the shaft 20. The rotating impeller 15 increases the fluid velocity. The fluid exits the impeller 15 and flows into an intermediate stage diffuser 22 where the increased velocity is converted to increased pressure. The higher pressure fluid then enters the return vanes 40 which guide the fluid to the next stage impeller 15. Additional stages are used as necessary to achieve the required discharge pressure. The stages shown in FIG. 2 are from a nine stage centrifugal pump.

Figure 4:
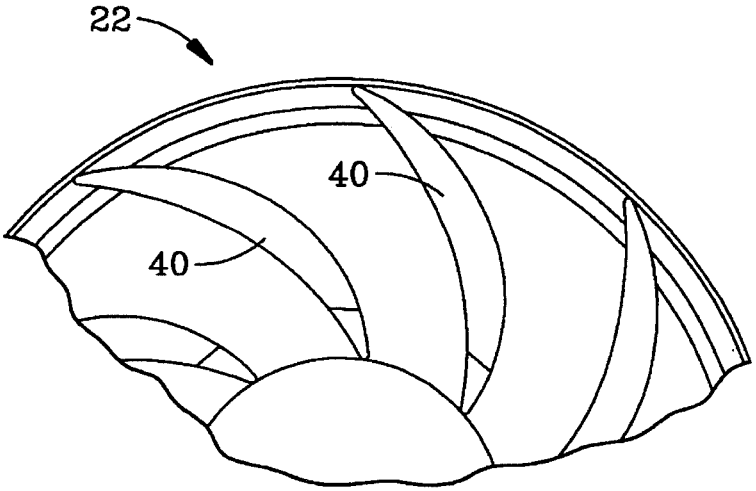
FIG. 4 is a left side view of a portion of one of the intermediate stage diffusers shown in FIG. 2.

FIG. 4 shows an intermediate stage diffuser 22 from FIG. 2. The return vanes 40 are located on the back side of the intermedi ate stage diffuser 22. The return vanes 40 extend from near the outer periphery of the intermediate stage diffuser 22 to near the inlet of the adjacent next stage impeller 15.

Figure 5:
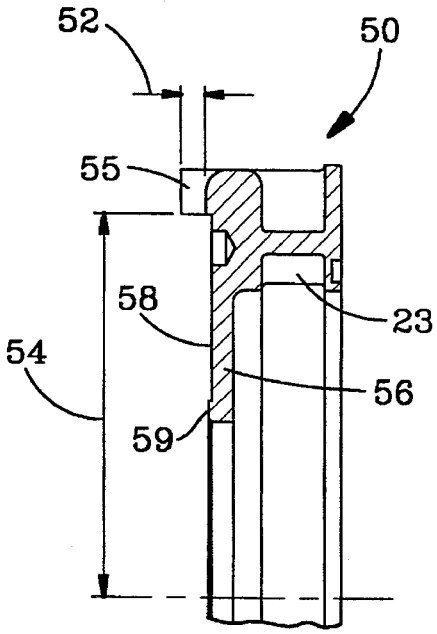
FIG. 5 is a partial cross-sectional view of a last stage diffuser.
Figure 6:
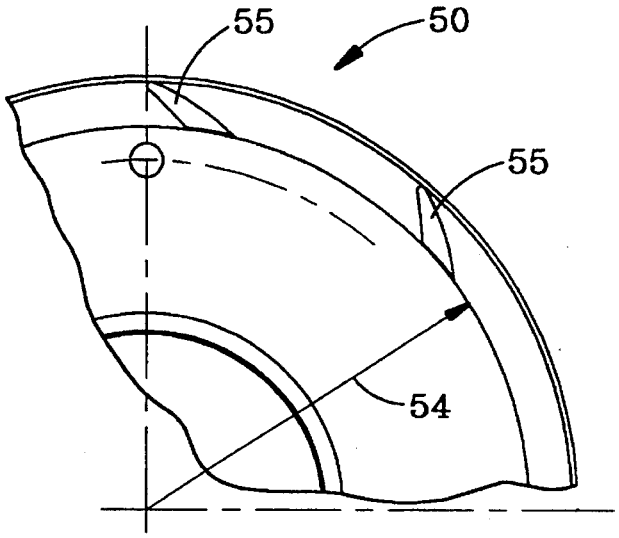
FIG. 6 is a left side view of a portion of the last stage diffuser shown in FIG. 5.

FIGS. 5 and 6 show a last stage diffuser 50. The last stage diffuser 50 has been designed as a compensator which loads the gaskets 31, 32 during pump operation and pump stand-by. Intermediate pressure gasket(s) 31 are present only if the pump 1 has an intermediate stage pressure take-off 35. The last stage diffuser 50 is designed as a spring which deflects under varying conditions and imparts a spring force on the channel rings 24 during assembly, stand-by and other operating conditions.

Preferably, the last stage diffuser 50 uses the same casting as the intermediate stage diffusers 22. The last stage diffuser 50 is modified in two areas to perform its function as a compensator. The return vanes 40 are machined to a toleranced height 52 and inside diameter 54, forming modified return vanes 55. The return vane height 52 is calculated such that during assembly, an axial force generated by the main pump bolting is applied directly to the suction gasket 32 by the pump end casing 4 through the modified return vanes 55 and the channel rings 24. The height 52 of the modified return vanes 55 establishes the preload and crush on the suction gasket 32. Shims (not shown) are used to adjust the assembly preload as necessary. The last stage diffuser base plate 56 which supports the modified return vanes 55 is used as a flexible disk spring. The base plate 56 is machined to a predetermined thickness which dictates the effective spring constant and the load/deflection characteristics of the last stage diffuser 50. An annular portion 58 of the base plate 56 is relieved to create a shoulder 59 adjacent the inner diameter of the last stage diffuser 50. The shoulder 59 contacts the inside of the pump end casing 4. The plate thickness and inside diameter of the relieved portion 58 of the base plate 56 are determined by using finite elements analysis to evaluate the stress, deflection and resulting spring force under the assembly preload, differential pressure force and anticipated thermal transients.

The last stage diffuser 50, as a spring, eliminates the problems with prior art expansion compensators. An assembly preload is generated which compresses the suction gasket preventing leakage during slow-roll. An axial load is maintained on the channel rings 24 and gaskets 31, 32 during thermal transients which will alleviate any problems a loose bundle may cause.

Although the preferred embodiment described above uses the last stage diffuser 50 to resiliently axially load the channel rings 24, the resilient axial loading can also be provided by any one or more of the intermediate stage diffusers 22.

Having described the invention, what is claimed is:

1. A multistage centrifugal pump comprising:

a pump housing having an inlet and an outlet;

a plurality of intermediate pumping stages within the pump housing, each intermediate pumping stage comprising an impeller, a diffuser member and a channel ring member; and a discharge pumping stage within the pump housing, the discharge pumping stage comprising an impeller and a diffuser member;

at least one diffuser member resiliently axially biasing the channel ring members.

2. The multistage centrifugal pump according to claim 1, wherein the discharge pumping stage diffuser member resiliently axially biases the channel ring members.

3. The multistage centrifugal pump according to claim 2, wherein the discharge pumping stage diffuser member is an annular disk having a first side and a second side, a plurality of diffuser vanes being on the first side of the annular disk, the second side of the annular disk having a relieved portion thereon and a shoulder portion adjacent the relieved portion and proximate the inner diameter of the annular disk, the discharge pumping stage diffuser member acting as a disk spring to axially bias the channel ring members.

4. The multistage centrifugal pump according to claim 3, wherein the pump housing has two end casings thereon, at least one end casing being removably attached to the pump housing, the discharge pumping stage diffuser member shoulder portion being in contact with one of the pump housing end casings.

5. A multistage centrifugal pump comprising:

a pump housing having an inlet and an outlet; and a plurality of pumping stages within the pump housing, the pressure of the pumping stages successively increasing from a suction pumping stage to a discharge pumping stage, the discharge pumping stage comprising an impeller and a discharge stage diffuser, the other pumping stages comprising an impeller, an intermediate stage diffuser member and a channel ring member, each intermediate stage diffuser member having a plurality of diffuser vanes thereon, the discharge stage diffuser member resiliently axially biasing the channel ring members.

6. The multistage centrifugal pump according to claim 5, wherein the discharge stage diffuser member is an annular disk, the annular disk acting as a disk spring which provides a spring force to axially bias the channel ring members.

7. The multistage centrifugal pump according to claim 5, wherein each intermediate stage diffuser member is an annular disk having a first side and a second side, the plurality of diffuser vanes being on the first side, a plurality of radially extending return vanes being on the second side, the return vanes extending from a first diameter to a second diameter, the first diameter being larger than the second diameter; and the discharge stage diffuser member being an annular disk having a first side and a second side, a plurality of diffuser vanes being on the first side of the annular disk, a plurality of radially extending shortened return vanes being on the second side of the annular disk, the discharge stage diffuser member shortened return vanes being shorter than the intermediate stage diffuser member return vanes.

8. The multistage centrifugal pump according to claim 7, wherein the discharge stage diffuser member shortened return vanes extend from a third diameter to a fourth diameter, the third diameter being larger than the fourth diameter, a portion of the second side of the discharge stage diffuser member annular disk being relieved forming a shoulder portion proximate the inner diameter of the annular disk, the relieved area extending from proximate the fourth diameter to the shoulder portion.

9. The multistage centrifugal pump according to claim 8, wherein the third diameter is the same as the first diameter.

10. The multistage centrifugal pump according to claim 7, wherein the intermediate stage diffuser member return vanes have a first height, the discharge stage diffuser member have a second height, the second height being less than the first height.

11. A diffuser for a centrifugal pump comprising:

an annular member having an inner circumference and an outer circumference and a first side and a second side;

a plurality of diffuser blades on the first side;

a plurality of return vanes on the second side, the return vanes extending from a first diameter to a second diameter, the first diameter being larger than the second diameter;

a portion of the second side of the annular member being relieved forming a shoulder portion proximate the inner circumference, the relieved area extending from proximate the second diameter to the shoulder portion.

* * * * *